US010595560B2

(12) United States Patent
Clark et al.

(10) Patent No.: US 10,595,560 B2
(45) **Date of Patent: *Mar. 24, 2020**

(54) SLIDE PUSH PACK FOR SMOKING ARTICLES

(71) Applicant: Altria Client Services LLC, Richmond, VA (US)

(72) Inventors: James Lindsay Clark, North Chesterfield, VA (US); Robert T. Mitten, Glen Allen, VA (US)

(73) Assignee: Altria Client Services LLC, Richmond, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/018,425

(22) Filed: Jun. 26, 2018

(65) Prior Publication Data

US 2018/0295878 A1 Oct. 18, 2018

Related U.S. Application Data

(63) Continuation of application No. 15/607,852, filed on May 30, 2017, now Pat. No. 10,021,908, which is a continuation of application No. 14/879,619, filed on Oct. 9, 2015, now Pat. No. 9,687,026.

(60) Provisional application No. 62/062,335, filed on Oct. 10, 2014.

(51) Int. Cl.
*A24F 15/12* (2006.01)
*B65D 85/10* (2006.01)

(52) U.S. Cl.
CPC ..... *A24F 15/12* (2013.01); *B65D 85/1054* (2013.01); *B65D 85/10* (2013.01)

(58) Field of Classification Search
CPC ..... A24F 15/12; A24F 15/14; A24F 15/16; B65D 85/105; B65D 85/1054; B65D 5/38; B65D 85/10
USPC ..... 206/268, 273
See application file for complete search history.

(56) References Cited

U.S. PATENT DOCUMENTS

| | | | |
|---|---|---|---|
| 2,597,810 | A | 5/1952 | Myers |
| 3,311,283 | A | 3/1967 | Shimada et al. |
| 3,899,125 | A | 8/1975 | Andrews et al. |
| 3,933,299 | A | 1/1976 | Shimada et al. |
| 3,977,520 | A | 8/1976 | Grimm |
| 439,993 | A | 11/1980 | Bailey |

(Continued)

FOREIGN PATENT DOCUMENTS

WO 2013/068959 A1 5/2013

*Primary Examiner* — Steven A. Reynolds
(74) *Attorney, Agent, or Firm* — Buchanan Ingersoll & Rooney PC

(57) ABSTRACT

A slide push pack for smoking articles and a method of packaging smoking articles are disclosed. The slide push pack includes an outer shell and an inner shell. The outer shell has a front panel, a back panel, a first side panel, and a second side panel, the back panel having a pair of guide rails and an inner channel, the front panel having a front finger window. The inner shell is configured to receive a pack of smoking articles. The inner shell includes an inner back panel, an outer back panel, a front panel, a first side panel, a second side panel, and a hinged-lid. The hinged-lid has a hinged-lid back panel configured to attach the hinged-lid to the back panel of the inner shell, and wherein the inner back panel includes an upper tab, and the outer back panel includes a mid-tab and a lower retention tab.

20 Claims, 9 Drawing Sheets

(56) References Cited

U.S. PATENT DOCUMENTS

| | | | | |
|---|---|---|---|---|
| 4,646,960 | A * | 3/1987 | Challand | B65D 85/1054 206/259 |
| 7,455,177 | B2 * | 11/2008 | Serafini | B65D 5/4204 206/265 |
| 7,658,280 | B2 * | 2/2010 | Bardet | B65D 5/6688 206/264 |
| 7,992,708 | B2 | 8/2011 | Hein et al. | |
| 8,042,685 | B2 | 10/2011 | Bourgoin et al. | |
| 9,687,026 | B2 * | 6/2017 | Clark | A24F 15/12 |
| 10,021,908 | B2 * | 7/2018 | Clark | A24F 15/12 |
| 2008/0128301 | A1 | 6/2008 | Bourgion et al. | |
| 2008/0142578 | A1 | 6/2008 | Vickerstaff | |
| 2009/0008277 | A1 | 1/2009 | Agirbas | |
| 2009/0065561 | A1 * | 3/2009 | Bourgoin | B65D 85/1054 229/129.1 |
| 2010/0155273 | A1 * | 6/2010 | Chatelain | B65D 5/38 206/265 |
| 2011/0062175 | A1 * | 3/2011 | Nakamura | B65D 85/1054 220/810 |
| 2013/0248392 | A1 * | 9/2013 | Roila | B65D 5/646 206/255 |
| 2014/0238877 | A1 | 8/2014 | Petrucci et al. | |
| 2015/0014404 | A1 | 1/2015 | Iwata et al. | |

* cited by examiner

SLIDE PUSH PACK FOR SMOKING ARTICLES

CROSS REFERENCE TO RELATED APPLICATION

This application is a continuation application of U.S. patent application Ser. No. 15/607,852, filed May 30, 2017, which is a continuation application of U.S. patent application Ser. No. 14/879,619, filed Oct. 9, 2015, now U.S. Pat. No. 9,687,026, issued Jun. 27, 2017, which claims priority under 35 U.S.C. § 119(e) to U.S. Provisional Patent Application No. 62/062,335, filed on Oct. 10, 2014, the entire contents of each are incorporated herein by reference.

SUMMARY

In accordance with an exemplary embodiment, a slide push pack is disclosed for smoking articles, the pack comprises: an outer shell, the outer shell having a front panel, a back panel, a first side panel, and a second side panel, the back panel having a pair of guide rails and an inner channel, the front panel having a front finger window; and an inner shell configured to receive a bundle of smoking articles, the inner shell comprising an inner back panel, an outer back panel, a front panel, a first side panel, a second side panel, and a hinged-lid, the hinged-lid having a hinged-lid back panel configured to attach the hinged-lid to the inner back panel of the inner shell, and wherein the outer back panel of the inner shell includes an upper tab, and the inner back panel includes a mid-tab and a lower retention tab, and each of the upper tab, the mid-tab, and the lower retention tab is configured to be received within the inner channel and between the pair of guide rails of the outer shell.

In accordance with an exemplary embodiment, a method is disclosed of packaging a bundle of smoking articles, the method comprises: erecting an outer shell from a first blank, the outer shell having a front panel, a back panel, a first side panel, and a second side panel, the back panel having a pair of guide rails and an inner channel, the front panel having a front finger window; and erecting an inner shell from a second blank, the inner shell having an inner back panel, an outer back panel, a front panel, a first side panel, a second side panel, a hinged-lid, and a hinged-lid back panel configured to attach the hinged-lid to the back panel, the inner back panel including an upper tab, and the outer back panel including a mid-tab and a lower retention tab, and wherein each of the upper tab, the mid-tab, and the lower retention tab is configured to be received within the inner channel and between the pair of guide rails of the outer shell.

In accordance with an exemplary embodiment, a slide and shell packaging is disclosed, comprising: an inner lid portion, an inner back panel and a hinged connection between said inner back panel and said inner lid portion: an outer lid portion and an outer back panel connected with said outer lid portion; a first tab operative with said outer back panel, said first tab cooperating with a first catch at a first location along said shell to arrest an upward movement of said outer back panel; a second tab operative with said inner back panel, said second tab defining a second catch at a location along said inner back panel and operative to engage an edge portion of said arrested outer back panel to arrest an upward movement of said inner back panel; said shell having a pair of spaced apart guide rails and an inner channel defined between said guide rails and a front panel having a front finger window; and said first and second tabs received by said inner channel, whereby a tendency of the packaging to bind is abated.

DETAILED DESCRIPTION

Figure 1:
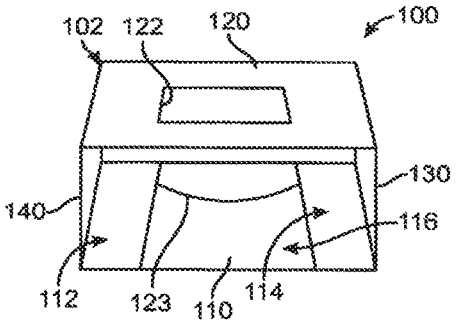
FIG. 1 is a perspective view of an outer shell of a slide push pack for smoking articles in accordance with an exemplary embodiment.
Figure 2:
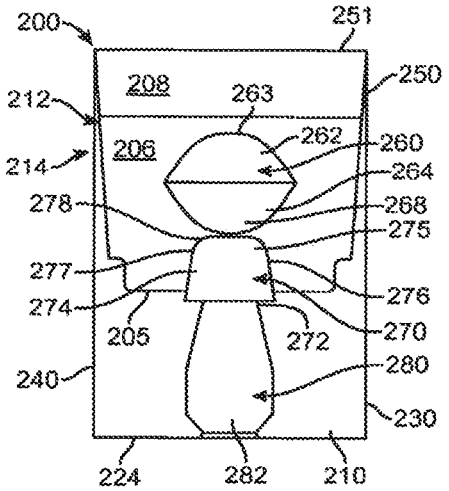
FIG. 2 is a back view of an inner shell of a slide push pack for smoking articles in accordance with an exemplary embodiment.

A slide opening paperboard smoking article pack 10 (FIG. 6) is disclosed, which is configured to receive a bundle 20 of smoking articles 30, for example, cigarettes, and which is adapted for easy one-handed operation. Referring now also to FIGS. 1 and 2, in accordance with an exemplary embodiment, the pack 10 includes an outer shell 100 with a front finger window (or slot) 122, and an inner shell 200 configured to hold a bundle 20 of smoking articles 30. The inner shell 200 can include a hinged-lid 250 that opens and closes in conjunction with the sliding action of the inner shell 200. For example, in accordance with an exemplary embodiment, the hinged-lid 250 readily tips away from the tipped end of the smoking articles, for example, cigarettes, as the inner shell 200 is raised and conversely the hinged-lid 250 is pulled down into position over the tipped end of the smoking articles 30 as the inner shell 200 is pulled down. The inner shell (or slide) 200 sliding action can be placed in motion by a user's finger or thumb that pushes and pulls the inner shell 200 through a front finger tip slot 290 of the outer shell 100. Alternatively, the sliding action of the inner shell 200 can be opened and closed by pushing on the bottom of the inner shell 200 to open and push down on the hinged-lid 250 to close the pack 10.

In accordance with an exemplary embodiment, the pack 10 can form a solid and durable pack construction, which can improve crush resistance, provide for one handed operation and ease of access to product. The design of the pack 10 can minimize hinged-lid tears due to multiple openings, prevent unintended openings in pockets or purses that occur with a standard hinge-lid box, and can enhance the pack structure and dispensing of product contained therein. In addition, the pack 10 can provide for multiple open and closing options based on consumer preference, for example, slide/slide and/or push/slide.

FIG. 1 is a perspective view of an outer shell 100 of a slide push pack 10 for a bundle 20 of smoking articles 30 (FIG. 5) in accordance with an exemplary embodiment. As shown in FIG. 1, the outer shell 100 can be configured as pre-glued cut sleeve 102 with a pair of folded guide rails 112, 114. The outer shell 100 can include a back panel 110, a front panel 120, a first side panel 130, and a second side panel 140.

In accordance with an exemplary embodiment, the back panel 110 can include a pair of folded guide rails 112, 114 and an inner channel 116 located between the pair of guide rails 112, 114. The pair of guide rails 112, 114 are configured to create the inner channel 116, which upon assembly with the inner shell 200 can reduce the friction created by the folded and raised inner tabs 260, 270, 280 on the inner back panel 210 of the inner shell 200 (FIG. 2). In accordance with an exemplary embodiment, the outer shell 100 also preferably includes a retention tab stop 150 (see also FIG. 11). The retention tab stop 150 can be located on a lower portion of the inner channel 116, and is configured to receive a retention tab 280 on the inner back panel 210 of the inner shell 200.

In accordance with an exemplary embodiment, the front panel 120 can include a front finger window (or slot) 122. The front finger window 122 is preferably an open hole or slot, which can be positioned on the front panel 120 preferably an equal distance from a top edge and a bottom edge of the front panel 120, and an equal distance from a left side edge and a right side edge of the front panel 120. Alternatively, in accordance with an exemplary embodiment, the front finger window 122 can be positioned closer and/or further away from either the top edge and/or bottom edge of the front panel 120 depending on consumer preference. In accordance with an exemplary embodiment, the front finger window 122 preferably has a rectangular or squared shape thereto. Alternatively, the front finger window 122 can be round or oval.

Figure 9:
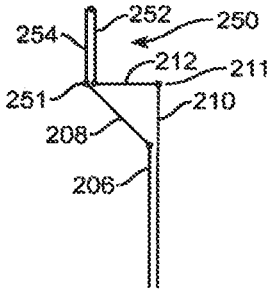
FIG. 9 is a diagram showing a hinged-lid of an assembled slide push pack for smoking articles in an open position.

FIG. 2 is a back view of an inner shell 200 of a slide push pack 10 for smoking articles in accordance with an exemplary embodiment. As shown in FIG. 2, the inner shell 200 can be configured as a die-cut wrap around sleeve 202 with a hinged-lid 250. The inner shell 200 is configured to receive a bundle of smoking articles 20. The inner shell 200 can include an outer back panel 206, an inner back panel 210, a front panel 220, a bottom panel 224, a first side panel 230, a second side panel 240, and having a hinged-lid 250. Referring now also to FIG. 9 in accordance with an exemplary embodiment, the hinged-lid 250 is connected and/or attached to the inner back panel 210 via a hinged-lid back panel 212, which can extend from an upper portion 214 of the inner back panel 210 to proximity of a top rear edge 251 of the hinged-lid 250.

In accordance with an exemplary embodiment, the outer shell 100 and the inner shell 200 can be locked together by a series of tabs and panel folds 260, 270, 280 that prevent the 2-part pack system from overextension or separation. In accordance with an exemplary embodiment, the outer back panel 206 of the slide (inner shell) 200 includes an upper folded tab 260, and the inner back panel 210 includes a mid-tab 270 and a lower retention tab 280. In accordance with an exemplary embodiment, the upper folded tab 260, the mid-tab 270, and the lower retention tab 280 are configured to be received within the inner channel 116 and between the pair of guide rails 112, 114 of the outer shell 100.

The series of tabs 260, 270, 280 can be die cut, and configured that when properly folded actuates the opening and closing of the hinged-lid 250. The tabs 260, 270, 280 are preferably positioned to slide between the guide rails 112, 114, within the inner channel 116 of the outer shell 100.

As shown in FIG. 2, the upper folded tab 260 in the outer back panel 206 of the slide (inner shell) 200 can be a 180 degree folded tab having a round and/or oval shape. In accordance with an exemplary embodiment, the upper tab 260 can be attached at a mid-point of the tab 260 to the outer back panel 206 forming an upper tab portion 262 and a lower open portion 264. The upper tab portion 262 has a free end 266, and the lower open portion 264 includes a lower edge 268. In accordance with an exemplary embodiment, the upper tab 260 can be configured to assist with the opening and closing of the hinged-lid 250 of the inner shell 200.

The mid-tab 270 can be configured to extend upward from a mid-portion of the inner back panel 210 of the inner shell 200. The mid-tab 270 has a lower edge 272 attached to the inner back panel 210 of the inner shell 200, a pair of angled side edges 274, 276, a free upper edge 278, and a pair of rounded edges or corners 275, 277 between the pair of angled side edges 274, 276 and the upper edge 278. In accordance with an exemplary embodiment, the mid-tab 270 is configured to limit the opening of the inner shell 200 during assembly and use.

The lower retention tab 280 can extend downward from the lower edge 272 of the mid-tab 270 and is configured to limit the closing of the inner shell during assembly and use. The lower retention tab 280 preferably includes an elongated tab extending downward having a free end on a lower edge 282, which can be configured to be received within the retention tab stop 150 on the outer shell 100.

Figure 3:
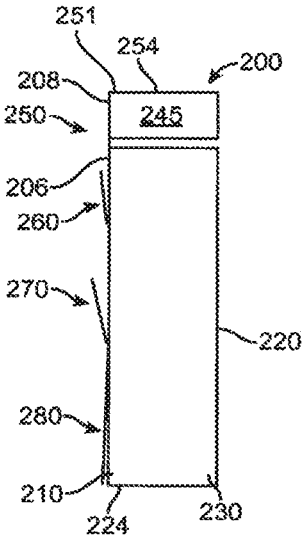
FIG. 3 is a side view of the inner shell of a slide push pack for smoking articles in accordance with an exemplary embodiment.

FIG. 3 is a side view of the inner shell 200 of a slide push pack 10 for smoking articles in accordance with an exemplary embodiment. Referring now also to FIG. 9, the hinged-lid 250 can include an inner top panel 252, an outer top lid panel 254 superposed over panel 252, and a pair of tuck-in flaps 256, 258, which are disposed between top panels 252 and 254 (see FIG. 7). In accordance with an exemplary embodiment, preferably a gap 802 is established between an upper edge of the side panel 230 and a lower edge of the lid side panel 240. A similar gap is established between side panel 240 and lid side panel 241.

As shown in FIG. 3, the inner shell 200 includes a series of tabs 260, 270, 280, which are configured when properly folded to actuate the opening and closing of the hinged-lid 250. The tabs 260, 270, 280 are preferably positioned to slide between the guide rails 112, 114, within the inner channel 116 of the outer shell 100 when the inner shell 200 is placed in the outer shell 100.

Figure 4:
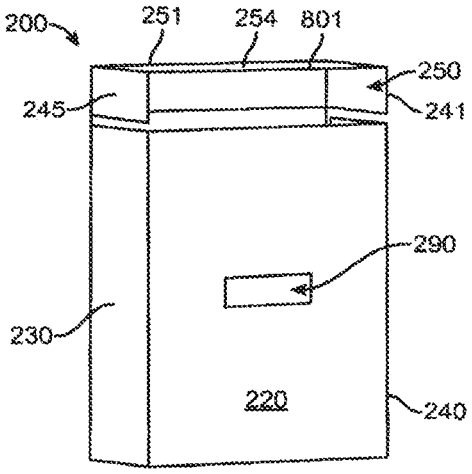
FIG. 4 a front view of the inner shell of a slide push pack for smoking articles in accordance with an exemplary embodiment.

FIG. 4 is a front perspective view of the inner shell 200 of a slide push pack 10 for smoking articles in accordance with an exemplary embodiment. As shown in FIG. 4, the front panel 220 of the inner shell 200 can include a finger tip slot 290, which is configured to be accessible via the front finger window 122 of the outer shell 100. The finger tip slot 290 is configured to facilitate a positive grasp to activate the sliding motion between the outer shell 100 and the inner shell 200. The finger tip slot 290 can preferably has a rectangular or squared shape thereto. Alternatively, the front finger tip slot 290 can be round or oval. The finger tip slot 290 preferably has a smaller outer perimeter than an outer perimeter of the front finger window (or slot) 122 within the outer shell 200. The larger outer perimeter in connection with finger window (or slot) 122 than the finger tip slot 290 allows access to the finger tip slot 290 by a consumer's finger as well as provide distance to allow the inner shell 200 to travel upwards and facilitate adequate opening of the lid 250.

Figure 5:
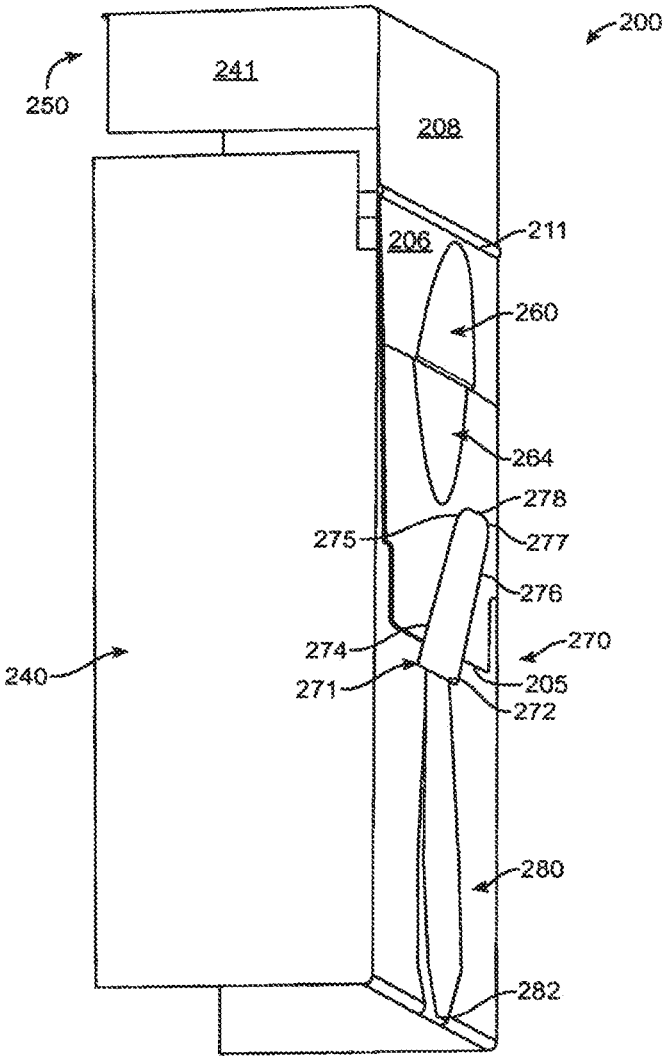
FIG. 5 a back view of the inner shell of a slide push pack for smoking articles in accordance with an exemplary embodiment.

FIG. 5 is a rear perspective view of the assembled inner shell 200 of a slide push pack 10 for smoking articles in accordance with an exemplary embodiment. As shown in FIG. 5, the upper folded tab 260 can be a 180 degree folded tab having a round and/or oval shape. In accordance with an exemplary embodiment, the upper tab 260 can be attached at a mid-point of the tab 260 to the outer back panel 206 forming an upper tab portion 262 and a lower open portion 264. In accordance with an exemplary embodiment, the upper tab 260 can be configured to assist with the opening and closing of the hinged-lid 250 of the inner shell 200.

The mid-tab 270 can be configured to extend upward from a mid-portion of the inner back panel 210 of the inner shell 200. The mid-tab 270 has a lower edge 272 attached to the inner back panel 210 of the inner shell 200, a pair of angled side edges 274, 276, a free upper edge 278, and a pair of rounded edges or corners 275, 277 between the pair of angled side edges 274, 276 and the upper edge 278. In accordance with an exemplary embodiment, the mid-tab 270 is configured to limit the opening of the inner shell 200 during assembly and use.

The lower retention tab 280 can extend downward from the lower edge 272 of the mid-tab 270 and is configured to limit the closing of the inner shell during assembly and use. The lower retention tab 280 preferably includes an elongated tab extending downward having a free end on a lower edge 282, which can be configured to be received within the retention tab stop 150 on the outer shell 100.

Figure 6:
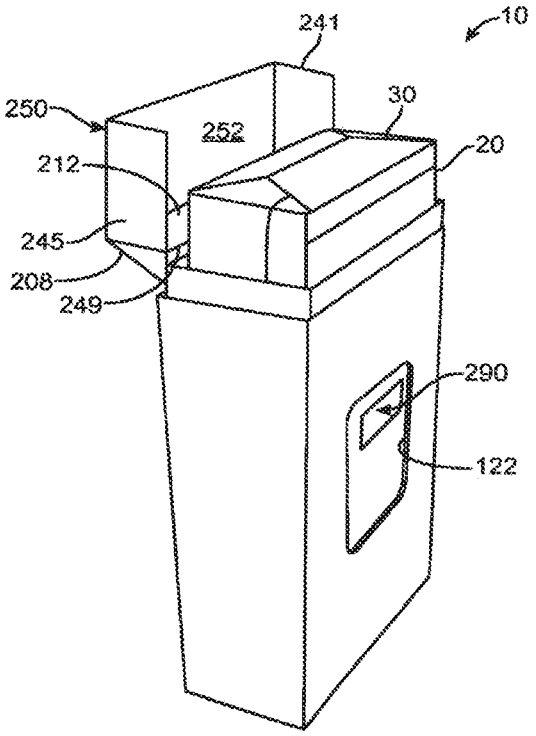
FIG. 6 is a perspective view of a fully assembled slide push pack for smoking articles in an open position in accordance with an exemplary embodiment.

FIG. 6 is a perspective view of an assembled slide push pack 10 for a bundle 20 of smoking articles 30 in an open position in accordance with an exemplary embodiment. The slide push pack 10 is configured to receive a wrapped bundle or bundle 20 of smoking articles 30, which can be accessed by pushing or shifting the inner shell 200 upward by placing the consumer's finger through the finger slot 150 on the outer shell 100 and engaging the finger tip slot 290 on the inner shell 200. The wrapped bundle 20 can house a bundle of cigarettes or other elongate smoking articles, the smoking articles being preferably wrapped in an inner liner of, for example, metal foil or metalized paper. In addition, the wrapped bundle 20 of elongate smoking articles or other consumer goods 30 can be shrink wrapped or otherwise over wrapped with a transparent polymeric film of, for example, polyethylene or polypropylene in a conventional manner. Where the wrapped bundle or bundle 20 of smoking articles or consumers goods 30 according to the disclosure are over wrapped, the over wrapper may include a tear tape.

As shown in FIG. 6, the assembled slide push pack 10 is preferably a substantially rectangular parallelepipedal shaped box, with right-angled longitudinal and right-angled transverse edges. In accordance with an exemplary embodiment, the sliding or movement of the inner shell 200 can be configured to lift upward (i.e., open) and/or lower (i.e., close) the hinged-lid 250 via the hinged-lid back panel 208.

Figure 7:
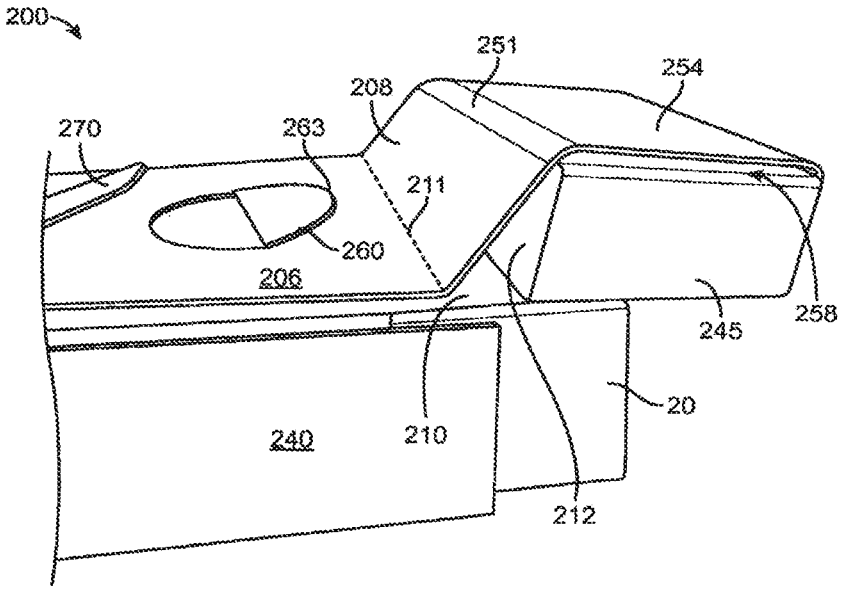
FIG. 7 is a perspective, partial view of a partially assembled slide push pack for smoking articles in an open position in accordance with an exemplary embodiment.

FIG. 7 is a perspective view of an assembled slide push pack 10 for smoking articles 30 in an open position in accordance with an exemplary embodiment. Referring now also to FIG. 9, the hinged-lid 250 can include the inner top lid panel 252 and an outer top lid panel 254, which can be glued together with an adhesive or glue. As shown in FIG. 7, the inner lid back panel 212 of the hinged-lid 250 is connected to the inner back panel 210. The hinged-lid 250 includes an inner top lid panel 252, the top outer lid panel 254, and the pair of tuck-in flaps 256, 258, disposed therebetween. In accordance with an exemplary embodiment, the pair of tuck-in flaps 256 and 258 are glued in between the panels 252, 254.

Figure 8:
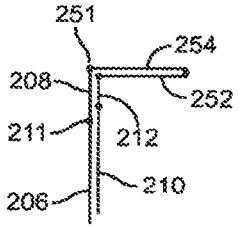
FIG. 8 is a diagram showing a hinged-lid of an assembled slide push pack for smoking articles in a closed position.

FIGS. 8 and 9 are diagrams showing a hinged-lid 250 of an assembled slide push pack 10 for smoking articles 30 in a closed position and an opened position, respectively. As shown in FIGS. 8 and 9, the hinged-lid 250 is configured to pivot about the hinge line 211 between panels 210, 212.

Figure 10:
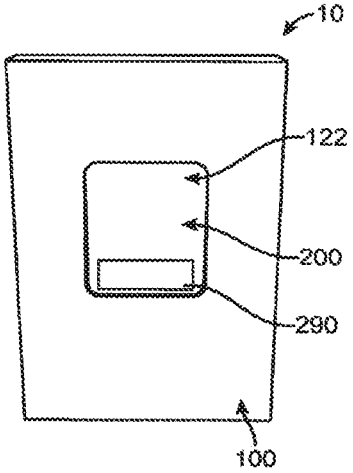
FIG. 10 is a perspective view of a partially assembled slide push pack for smoking articles in a closed position in accordance with an exemplary embodiment.

FIG. 10 is a perspective view of an assembled slide push pack 10 for a bundle 20 of smoking articles 30 in a closed position in accordance with an exemplary embodiment. As shown in FIG. 10, upon closure of the hinged-lid 250, the finger tip slot 290 on the inner shell 200 preferably is positioned at a lower portion of the finger window (or slot) 122 and the finger tip slot 290 moves upward during opening of the pack 10.

Figure 11A:
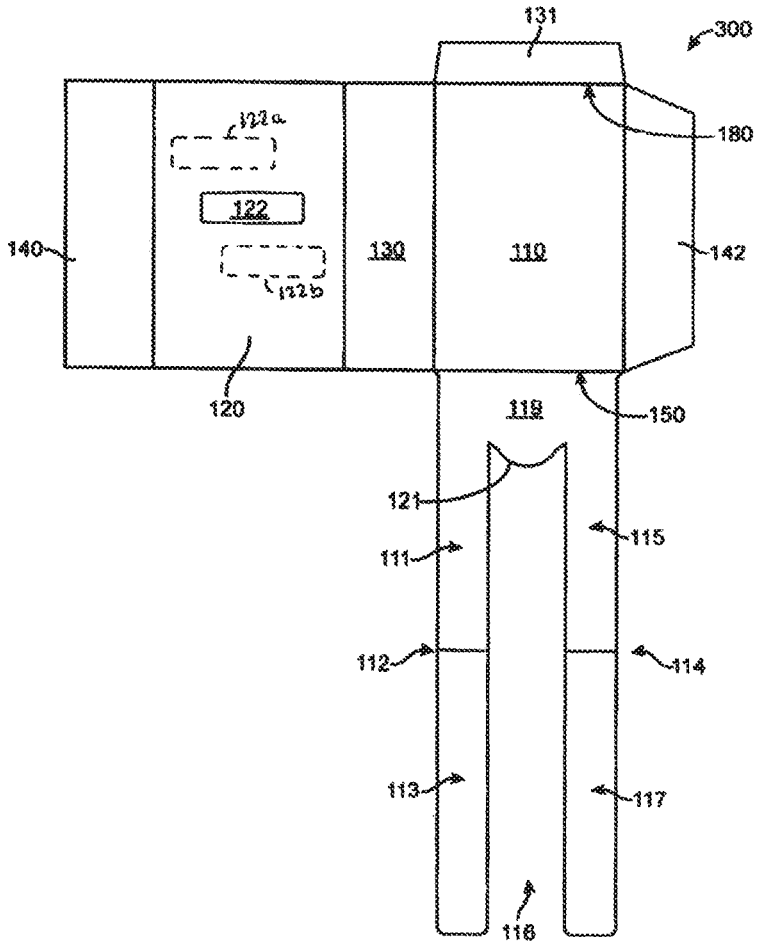
FIG. 11A is a blank for an outer shell of a slide push pack for smoking articles in accordance with an exemplary embodiment.

FIG. 11A is a blank 300 for an outer shell 100 of a slide push pack 10 for smoking articles 30 in accordance with an exemplary embodiment. As shown in FIG. 11A, the blank 300 includes a pair of folded guide rails 112, 114, each of the pair of folded guide rails 112, 114, having an inner panel 111, 115, which is connected along a horizontal fold line to the back panel 110, and an outer panel 113, 117, which is connected along a horizontal fold line to the inner panel 111, 115. The outer shell 100 can include a back panel 110 having a side glue panel 142 connected along a vertical fold line of the back panel 110, and a top retention panel 131 is connected to the back panel 110 along a horizontal fold line. During assembly, the outer panels 113, 117, are folded (out of the page of FIG. 11A) into superposed relation to panels 111, 115, respectively, and then inner panel 119 is folded (out of the page of FIG. 11A into superposed relation with back panel 110, where upon the retention panel 131 is folded over the adjacent end portions of the rails 112, 114. The retention panel 131 is configured to be attached to a free end (or end portion) of the outer panels 113, 117, of the folded guide rails 112, 114 and optionally, may be glued thereto. The blank 300 also includes a front panel 120, which is connected along a pair of horizontal fold lines to the first side panel 130 and the second side panel 140.

Upon assembly of the outer shell 100, the back panel 110 in combination with the pair of folded guide rails 112, 114 forms the inner channel 116 located between the pair of guide rails 112, 114. The pair of guide rails 112, 114 is configured to create the inner channel 116, which upon assembly with the inner shell 200 can reduce the friction that would otherwise be created by the folded and raised inner tabs 260, 270, 280 on an inner back panel 210 of the inner shell 200 (FIG. 2).

In accordance with an exemplary embodiment, the outer shell 100 also preferably includes a retention tab stop 150, which is formed at the fold line or nip between the back panel 110 and an inner panel 119, which extends between the pair of guide rails 112, 114 and which forms the base of the pair of guide rails 112, 114. The inner panel 119 can include a free edge 121 on an upper portion of the inner panel portion 119 (once folded), which has a circular shape thereto. Upon assembly of the outer shell 100, the retention tab stop 150 can be located on a lower portion of the inner channel 116, and is configured to receive the retention tab 280 on the inner back panel 210 of the inner shell 200. The retention tab stop 150 may serve to limit the downward movement of the slide 208 so as to establish a fully closed position of the pack 10.

In accordance with an exemplary embodiment, the front panel 120 can include a front finger window (or slot) 122. The front finger window 122 is preferably an open hole or slot, which can be positioned on the front panel 120 preferably an equal distance from a top edge and a bottom edge of the front panel 120, and an equal distance from a left side edge and a right side edge of the front panel 120. Alternatively, in accordance with an exemplary embodiment, the finger slot 122 can be positioned closer and/or further away from either the top edge and/or bottom edge of the front panel 120 depending on consumer preference. In accordance with an exemplary embodiment, the finger slot 122 preferably has a rectangular or squared shape thereto. Alternatively, the front finger window 122 can be round or oval.

Figure 12:
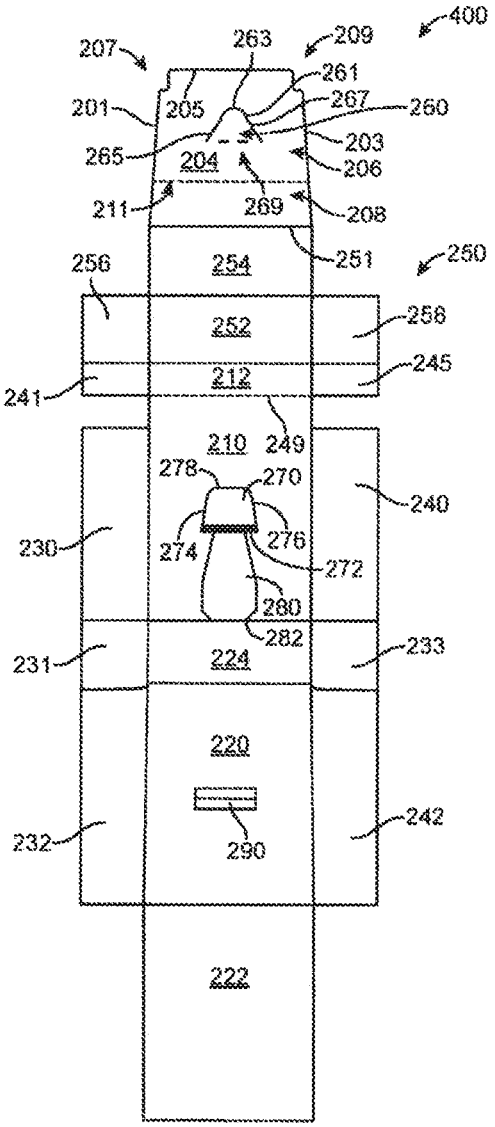
FIG. 12 is a blank for an inner shell of a slide push pack for smoking articles in accordance with an exemplary embodiment.

FIG. 12 is a blank 400 for an inner shell or slide 200 of a slide push pack 10 of smoking articles 30 in accordance with an exemplary embodiment. As shown in FIG. 12, the blank 400 includes an inner back panel 210, a front panel 220, a bottom panel 224, a first side panel 230, a second side panel 240, and having a hinged-lid 250. The inner back panel is connected along a horizontal perforation line or fold line 249 with the inner hinged-lid back panel 212. The pair of side panels 230, 240 can be connected along a pair of vertical fold lines to the inner back panel 210. A pair of side panels 241, 245 can be positioned on each side of the inner hinged-lid back panel 212.

The bottom panel 224 has a pair of inner dust flaps 231, 233 connected along a vertical fold line on each side of the bottom panel 224. In accordance with an exemplary embodiment, the front panel 220 is connected along a horizontal fold line to the bottom panel 224. A pair of inner panels 232, 242, is connected along a vertical fold line to the front panel 220. An inner flap panel 222 having a generally rectangular shape is connected along a horizontal fold line to the front panel 220. The front panel 220 includes the finger tip slot (or cutout) 290. Upon assembly, the panel 222 is folded and glued into a superposed relation with the front panel 220.

In accordance with an exemplary embodiment, the hinged-lid 250 is connected and/or attached to the inner back panel 210 via an inner hinged-lid back panel 212. The hinged-lid 250 includes an inner top lid panel 252, the outer top lid panel 254, and the pair of tuck-in flaps 256, 258. Referring to FIG. 12, the tuck-in flap 258 is joined to an upper edge of the side panel 245 along a fold line, and is separate of panel 252 by a cut-line so that in the assembly of the lid, the flap 258 may be tucked between the inner and outer top panels 252 and 254. Likewise, the tuck in flap 256 is joined to an upper edge of the side panel 245 along a fold line, and is separate of panel 252 by a cut-line so that in the assembly of the lid, the flap 256 may be tucked between the inner and outer top panels 252 and 254. An outer panel 204 is connected to the outer top lid panel 254 and includes an outer back (rear) lid panel 208 and an outer back panel 206, which are separated by a perforation or fold line 211. The upper folded tab 260 is located within panel 206 and formed by a partial cutout 261 (see FIG. 12), preferably having a round upper edge 263 and a pair of flared edges 265, 267 extending outward. A horizontal fold line (or perforation line) 269 extends from a lower edge of each the pair of flared edges 265, 267 to form a base of the tab 260. A pair of rectangular cutouts 207, 209 is positioned on an outer free edge 205 of the inner back panel 206. In accordance with an exemplary embodiment, the outer side edges 201, 203 of the inner panel 204 can be tapered inward towards the outer free edge 205.

In accordance with an exemplary embodiment, upon assembly of the inner shell 200, the upper folded tab 260, the mid-tab 270, and the lower retention tab 280 can be configured to be received within the inner channel 116 and between the pair of guide rails 112, 114 of the outer shell 100. As disclosed, the series of tabs 260, 270, 280 can be die cut, and configured that when properly folded actuates the opening and closing of the hinged-lid 250. The tabs 260, 270, 280 are preferably positioned to slide between the guide rails 112, 114, and within the inner channel 116 of the outer shell 100. In accordance with an exemplary embodiment, by positioning or locating tabs 260, 270, 280 along a center gap between the rails 112, 114, the hinged-lid 250 can easily open without binding against one or more of the tabs 260, 270, 280. In addition, tabs 260, 270 can control the upward and downward movement of the hinged-lid 250 during opening and closing, which can help prevent hinged-lid 250 from tearing from over articulation during use.

Figure 11B:
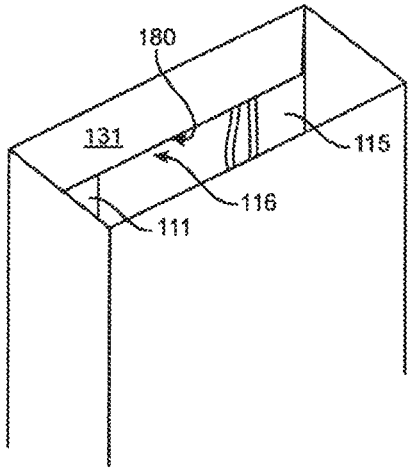
FIG. 11B is a perspective, partial view of the outer shell of a slide push pack for smoking articles in accordance with an exemplary embodiment.

Referring now to FIG. 11B, when the panel 131 is folded over into a superposed relation with the back panel 110 it defines a stop 180 at the nip (fold line) between the panels 131 and 110. Upon upward movement of the slide 200, the tab 260 of the outer back panel 206 of the slide 200 engages the stop 180 and further upward movement of the outer pack panel 206 is arrested (stopped). Consequently, further upward movement of the slide 200 causes the inner back panel 210 to move upwardly relative to the fixed outer back panel 206 (the panel 206 being fixed from the aforementioned engagement with the stop 180). The relative motion causes the lid 250 to pivot about the hinge line/perforation line 211 from its closed position toward its fully open (retracted) position. The upward movement of the slide 200 may continue until the lower edge 205 of the outer back panel 206 is engaged by the stop 271 defined by the fold line (nip) between the tab 270 and the inner back panel 210 (at the lower edge 272 of the inner back panel 210). Thereupon both the upward movement of the slide 200 and further pivoting motion of the lid 250 are arrested. The amount of pivoting is a function of the distance tween the lower edge 205 of the outer back panel 206 and the stop 271 (as measured when the pack 10 is in a fully closed position). The maximum possible vertical displacement of the slide 200 is the sum of the aforementioned distance and the distance between the top edge 263 of tab 260 and the stop 180 of the outer shell 200, as measured when the pack 10 is in a fully closed position.

Upon moving the slide 200 downwardly from its fully open position, the relative motion of the inner and outer back panels 210, 206 and the upper edge portion of the rear (back) panel 110 of the shell 100 pivots the lid 250 back toward its closed position. The downward movement of the slide 200 may continue until the lower end portion 282 of the tab 280 engages the stop 150 defined at the nip (fold line) between the panels 119 and 110. The arcuate portion 121 of the panel 119 helps retain the lower end portion 282 of the tab 280 between the panels 119 and 110 throughout the movement of the slide 200.

In accordance with exemplary embodiment, the outer shell 100 and the inner shell 200 can be formed of a material selected from the group consisting of cardboard, paperboard, plastic, metal, or combinations thereof. For example, in a preferred embodiment, the outer shell 100 and the inner shell 200 can be formed of cardboard having a weight ranging from about 100 grams per square meter to about 350 grams per square meter.

In accordance with another exemplary embodiment, the, the outer shell 100 and the inner shell 200 can include one or more of printing, embossing, debossing, embellishments and combinations thereof on an outer surface of the, the outer shell 100 and the inner shell 200.

As used herein, the terms "front", "back", "upper, "lower", "side", "top", "bottom", "left", "right" and other terms used to describe relative positions of the components of the sleeve refer to the sleeve in an upright position.

As used herein, the term "longitudinal" or "vertical" refers to a direction from bottom to top or vice versa of the outer shell 100 and the inner shell 200. The term "transverse" or "horizontal" refers to a direction perpendicular to the longitudinal direction.

In this specification, the word "about" is sometimes used in connection with numerical values to indicate that mathematical precision is not intended. Accordingly, where the word "about" is used with a numerical value, that numerical value should be interpreted to include a tolerance ±10% of the stated numerical value.

It will now be apparent to those skilled in the art that the foregoing specification describes with particularity a slide push pack. Moreover, it will also be apparent to those skilled in the art that various modifications, substitutions, variations, and equivalents exist for claimed features of the slide push pack. Accordingly, it is expressly intended that all such modifications, substitutions, variations, and equivalents for claimed features of the slide push pack, which fall within the spirit and scope of the invention as defined by the appended claims, be embraced thereby.

What is claimed is:

1. An outer shell of a slide push pack, the outer shell comprising:

a first side panel having a left edge connected along a first fold line to a right edge of a front panel, a second side panel having a right edge connected along a second fold line to a left edge of the front panel, a back panel having a left edge connected along a third fold line to a right edge of the first side panel, a side glue panel having a left edge connected along a fourth fold line to a right edge of the back panel, a top retention panel connected along a fifth fold line to a top edge of the back panel, and an inner panel connected along a sixth fold line to a bottom edge of the back panel;

the inner panel including first and second guide rails separated by a gap, the inner panel configured to be folded over the back panel such that the gap between the first and second guide rails forms a channel inside the outer shell, and the top retention panel configured to be folded over the back panel and end portions of the first and second guide rails.

2. The outer shell of claim 1, wherein the first guide rail includes an inner guide rail panel and an outer guide rail panel connected along a seventh fold line, and the second guide rail includes an inner guide rail panel and an outer guide rail panel connected along an eighth fold line, the outer guide rail panels folded into superposed relation to the inner guide rail panels, the inner panel folded into superposed relation with the back panel, and the top retention panel folded over a portion of the first guide rail and a portion of the second guide rail.

3. The outer shell of claim 2, wherein the inner panel includes an arcuate portion extending between the inner guide rail panels.

4. The outer shell of claim 1, wherein the outer shell is made of cardboard, paperboard, plastic, metal, a sub-combination thereof, or a combination thereof.

5. The outer shell of claim 3, wherein the arcuate portion is configured to receive a retention tab of an inner back panel of an inner shell.

6. The outer shell of claim 5, wherein the sixth fold line is configured to limit downward movement of the retention tab and therefore limit downward movement of the inner shell.

7. The outer shell of claim 1, wherein the front panel includes a finger window.

8. The outer shell of claim 1, wherein the top retention panel is configured to receive a folded tab of an outer back panel of an inner shell.

9. The outer shell of claim 8, wherein the top retention panel is further configured to limit upward movement of the folded tab of the outer back panel of the inner shell.

10. The outer shell of claim 8, wherein the fifth fold line is configured to limit upward movement of the folded tab of the outer back panel of the inner shell.

11. An inner shell of a slide push pack, the inner shell comprising an inner back panel, a front panel, and a bottom panel connected along a first fold line to the inner back panel and connected along a second fold line to the front panel, wherein the inner back panel is connected along a third fold line to an inner back lid panel of a hinged lid that includes left and right lid side panels, and wherein the inner back panel includes a cutout forming a mid retention tab, the mid retention tab having a lower edge attached to the inner back panel and an upper free edge, the hinged lid further includes an inner top lid panel connected along a fourth fold line to the inner back lid panel, an outer top lid panel connected along a fifth fold line to the inner top lid panel, an outer back lid panel connected along a sixth fold line to the outer top lid panel, and an outer panel connected along a seventh fold line to the outer back lid panel, the outer panel including a cutout defining an upper folded tab.

12. The inner shell of claim 11, wherein the hinged-lid further includes left and right tuck-in flaps, and wherein the right tuck-in flap is connected to the right lid side panel along a fold line, and is separated from the inner top lid panel by a cut-line so that the right tuck-in flap is tucked between the inner and outer top lid panels, and the left tuck-in flap is connected to the left lid side panel along a fold line, and is separated from the inner top lid panel by a cut-line so that the left tuck-in flap is tucked between the inner and outer top lid panels.

13. The inner shell of claim 11, wherein the mid retention tab is configured to limit downward movement of the outer panel relative to the inner back panel.

14. The inner shell of claim 11, wherein the upper folded tab is configured to be received by a top retention panel of an outer shell, the top retention panel configured to limit upward movement of the upper folded tab.

15. The inner shell of claim 11, wherein the upper folded tab includes a round upper edge and rounded or flared left and right edges, and a fold line extending between a lower portion of the edges to form a base of the upper folded tab.

16. The inner shell of claim 11, wherein left and right side edges of the outer panel are tapered inward towards a free edge of the outer panel.

17. The inner shell of claim 11, wherein the inner shell is configured such that the upper folded tab and the mid retention tab can be received within an inner channel between a pair of guide rails of an outer shell.

18. The inner shell of claim 11, wherein the inner back panel further includes a cutout forming a lower retention tab.

19. The inner shell of claim 18, wherein the lower retention tab is configured to be received by an inner panel of an outer shell, the inner panel configured to limit downward movement of the lower retention tab.

20. A slide push pack, the pack comprising:

an outer shell including a front panel, a back panel, a first side panel, and a second side panel, a top retention panel connected along a fold line to a top edge of the back panel, and an inner panel including a pair of guide rails, the inner panel connected along a fold line to a bottom edge of the back panel, the inner panel folded over the back panel such that a gap between the pair of guide rails forms an inner channel inside the outer shell, and the top retention panel folded over the back panel and end portions of the pair of guide rails, the front panel including a front finger window; and an inner shell configured to receive a bundle of tobacco articles, the inner shell including an inner back panel, an outer back panel, a front panel, and a hinged-lid, the hinged-lid including a hinged-lid back panel connected to the inner back panel, and wherein the inner back panel includes at least one tab configured to be received in the inner channel between the pair of guide rails of the outer shell, the tab having a lower edge attached to the inner back panel and an upper free edge.

* * * * *